US005667403A

United States Patent [19]

Fukuda et al.

[11] Patent Number: 5,667,403

[45] Date of Patent: Sep. 16, 1997

[54] CONNECTOR ENGAGEMENT DETECTING APPARATUS

[75] Inventors: Masaru Fukuda; Eiji Fukuda, both of Shizuoka; Kazuyuki Shiraki; Kouichi Shirouzu, both of Toyota, all of Japan

[73] Assignees: Yazaki Corporation, Tokyo; Toyota Jidosha Kabushiki Kaisha, Aichi, both of Japan

[21] Appl. No.: 360,569

[22] Filed: Dec. 21, 1994

[30] Foreign Application Priority Data

Dec. 28, 1993 [JP] Japan ..... 5-337554

[51] Int. Cl.[6] ..... H01R 13/17

[52] U.S. Cl. ..... 439/489; 439/188

[58] Field of Search ..... 439/488, 489, 439/490, 188; 200/51.09–51.11

[56] References Cited

U.S. PATENT DOCUMENTS

| | | | |
|---|---|---|---|
| 4,900,267 | 2/1990 | Nagasaka et al. | 439/489 |
| 5,055,058 | 10/1991 | Nagasaka | 439/188 |
| 5,127,848 | 7/1992 | Taguchi | 439/489 |
| 5,131,865 | 7/1992 | Taguchi et al. | 439/489 |
| 5,263,872 | 11/1993 | Marpoe, Jr. et al. | 439/188 |
| 5,277,608 | 1/1994 | Oda | 439/188 |

FOREIGN PATENT DOCUMENTS

| | | |
|---|---|---|
| 0 448 084 A1 | 9/1991 | European Pat. Off. . |
| 0 448 083 A1 | 9/1991 | European Pat. Off. . |
| 0 621 658 A2 | 10/1994 | European Pat. Off. . |
| 43 11 767 A1 | 10/1993 | Germany . |
| 2-50982 | 4/1990 | Japan . |
| 3-82574 | 8/1991 | Japan . |
| 3-274685 | 12/1991 | Japan . |
| 3-274686 | 12/1991 | Japan . |
| 3-272578 | 12/1991 | Japan . |
| 4-72576 | 6/1992 | Japan . |

*Primary Examiner*—Hien Vu

*Attorney, Agent, or Firm*—Armstrong, Westerman, Hattori, McLeland & Naughton

[57] ABSTRACT

This invention relates to a connector engagement detecting apparatus having a compact checking structure. In the first connector housing A', a short-circuit contact piece 19 with an elastic contact strip 19*c* is provided as positioned on the side of a deflectable space for a resilient lock arm 14, a shirt-circuit contact portion 19*c* 3 of the elastic contact strip 19*c* being opposed and spaced out to a bottom wall of the deflectable space, further, an depressing portion 19*d* of the elastic contact piece 19*c* being extended above over the bottom wall and opposed to the resilient lock arm 14, thereby, the elastic contact piece 19*c* being deflected according to the deflection of the resilient lock arm 14, on a supporting frame 17 in the second connector housing B', a couple of terminal pins D"/D" for detecting engagement being provided to be opposed to the short-circuit contact piece, when the first connector housing A' and the second connector housing B' are incompletely engaged, the resilient lock arm 14 being deflected to deform the short-circuit contact piece 19*C* not to make contact with a couple of the terminal pins D"/D" for detecting engagement.

10 Claims, 6 Drawing Sheets

CONNECTOR ENGAGEMENT DETECTING APPARATUS

BACKGROUND OF THE INVENTION

1. Field of the Invention

This invention relates to a couple of connectors for use as automobile wiring harnesses, or the like, and more particularly to a connector engagement detecting apparatus having means for detecting a completely engaged state of a couple of the connectors. Further, this invention relates to a short-circuit contact piece used in the engagement detecting apparatus.

2. Prior Art

Referring to FIG.8 and 9, A designates a male connector housing, B designates a female connector housing, and each of them is formed of synthetic-resin materials.

In the male connector housing A, a plurality of terminal receiving cavities 1 are formed, as well known, and female terminal pieces C are inserted to be secured therein. Similarly, in the female connector housing B, a plurality of terminal receiving cavities (not illustrated) are formed and male terminal pieces D are inserted to be secured therein.

In a concave portion 2 of an upper surface of the male connector housing A, a cantilever resilient lock arm 3 with a vertical base member 3*a* is provided as extending afterward. On an upper surface of a middle part of the resilient lock arm 3, a lock projection 3*b* is formed, and on a free end of the resilient lock arm 3, a push portion 3*c* for unlocking is provided. On a center portion of a forward end of a top wall 4 composing the female connector housing B, an engage-frame 5 for depressing to the resilient lock arm 3 is provided, and a lock opening 5*a* for cooperating with the lock projection 3*b* to return it to its original position is also formed on the top wall 4.

The aforementioned structure is a well known art, wherein, when the male connector housing A and the female connector housing B engage with each other, the female terminal pieces C and the male terminal pieces D make contact with each other. At that time, the lock projection 3*b* abuts on the engage-frame 5, whereby the resilient lock arm 3 deflects downwardly as retaining resilience into a lower space R for allowing a deflection of the resilient lock arm 3 and thereafter the lock projection 3*b* reaches to the lock opening 5*a*, and as the resilient lock arm 3 returns to the original position, the male connector housing A and the female connector housing B are completely engaged with each other and locked thereby.

Numeral 6 denotes a contact piece for detecting engagement. The contact piece 6 has a couple of elastic contact portions 6*b*/6*b* which rise up from a folded corner 6' at one end of a base plate 6*a* and has, at the other end of the base plate 6*a*, a terminal nose piece 6*c* being folded oppositely to the elastic contact portion 6*b*. The terminal nose piece 6*c* has a tab which extends afterward from a folded corner 6" thereof. The contact piece 6 for detecting engagement is secured by engaging the folded corner 6' of each contact position with an end of a compartment wall 8 between the concave portion 2 and the terminal receiving cavity 1' adjacent to the concave portion 2. Thereby, the couple of the elastic contact portions 6*b*/6*b* are cause to rise up in the space R for allowing a deflection in opposition to the free end of the resilient lock arm 3. And, the terminal nose pieces 6*c*/6*c* with the tab are secured backwardly in the terminal receiving cavity 1'/1'. The terminal nose pieces 6*c*/6*c* with the tab are connected with the normal female terminal pieces C. Thereby, an electric detection circuit is composed.

Numeral 7 designates a short-circuit contact piece which is formed of an elastic metal and is gate-shaped. Both leg pieces 7*a*/7*a* of the short-circuit contact piece 7 each have an outwardly folded contact piece 7*b*. The short-circuit contact piece 7, wherein the folded contact pieces 7*b*/7*b* are each engaged with a corresponding strip 5*b* of the engage-frame 5, is fixed to the engage frame 5 with an adhesive, and so on.

In the above-mentioned structure, when the male connector housing A and the female connector housing B are incompletely engaged with each other, the free end of the resilient lock arm 3, as illustrated in FIG. 9B, deflects downwardly and also forces deflection of the elastic contact portions 6*b*/6*b* of the contact pieces 6/6 for detecting engagement. Therefore, as the short-circuit contact piece 7 is isolated from the elastic contact portions 6*b*/6*b*, the detecting electric circuit does not work.

On the other hand, when the male connector housing A and the female connector housing B are completely engaged to each other, the resilient lock arm 3, as illustrated in FIG. 9C, returns to the original position and also the elastic contact portions 6*b*/6*b* of the contact pieces 6/6 for detecting engagement return to the original position. Thereby, the elastic contact portions 6*b*/6*b* make contact with the short-circuit contact piece 7 and the detecting electric circuit gets to work.

In the above-mentioned prior art device, the male connector housing with the resilient lock arm has a couple of the contact pieces for detecting engagement, and the female connector housing has the short-circuit contact piece. Further, the male connector housing has a couple of the female terminal pieces which are connected to the contact pieces to detect the complete engagement. Consequently, the engagement checking structure is so complicated that more compact ones have been sought.

SUMMARY OF THE DISCLOSURE

This invention aims to solve the above problem and provides a more compact connector engagement detecting apparatus by leaving out the above-mentioned contact pieces to detect the complete engagement.

To achieve the object, in this invention, a connector engagement detecting apparatus comprises:

a first connector housing with a resilient lock arm; and, a second connector housing having an engaging portion for the resilient lock arm; wherein, in the first connector housing, a short-circuit contact piece with an elastic contact strip is provided as positioned under a deflectable space for the resilient lock arm, a shirt-circuit contact portion of the elastic contact strip being opposed and extended to a bottom wall of the deflectable space, further, a depressing portion of the elastic contact piece being extended above over the bottom wall and opposed to the resilient lock arm, thereby, the elastic contact piece being deflected according to the deflection of the resilient lock arm, on a supporting frame in the second connector housing, a couple of terminal pins for detecting engagement being provided in opposition to the short-circuit contact piece, when the first and the second connector housings are completely engaged with each other, the short-circuit contact piece making contact with the couple of the terminal pins for detecting engagement, when the first and the second connector housings are incompletely engaged with each other, the resilient lock arm being deflected to deform the short-circuit contact piece not to make contact with the couple of the terminal pins for detecting engagement.

Further, in the connector engagement detecting apparatus according to this invention, the supporting frame is preferably formed so as to extend forward from a rear wall of the second connector housing and compensating ribs are preferably provided on the supporting frame.

Moreover, in the connector engagement detecting apparatus according to this invention, the supporting frame extends ahead of the tips of the terminal pins for detecting engagement.

In operation, when a couple of the connectors are incompletely engaged with each other, the elastic contact strip of the short-circuit contact piece is forcibly isolated from the terminal pin for detecting engagement.

On the other hand, when a couple of the connectors are completely engaged with each other, the elastic contact strip returns to the original position, and thereby is abutting to the terminal pin for detecting engagement.

Other aspects of this invention will be apparent in the following description and accompanied drawings of a preferred embodiment.

BRIEF DESCRIPTION OF THE DRAWINGS

In a longitudinal sectional view of the above prior art.

DESCRIPTION OF PREFERRED EMBODIMENT

Figure 1:
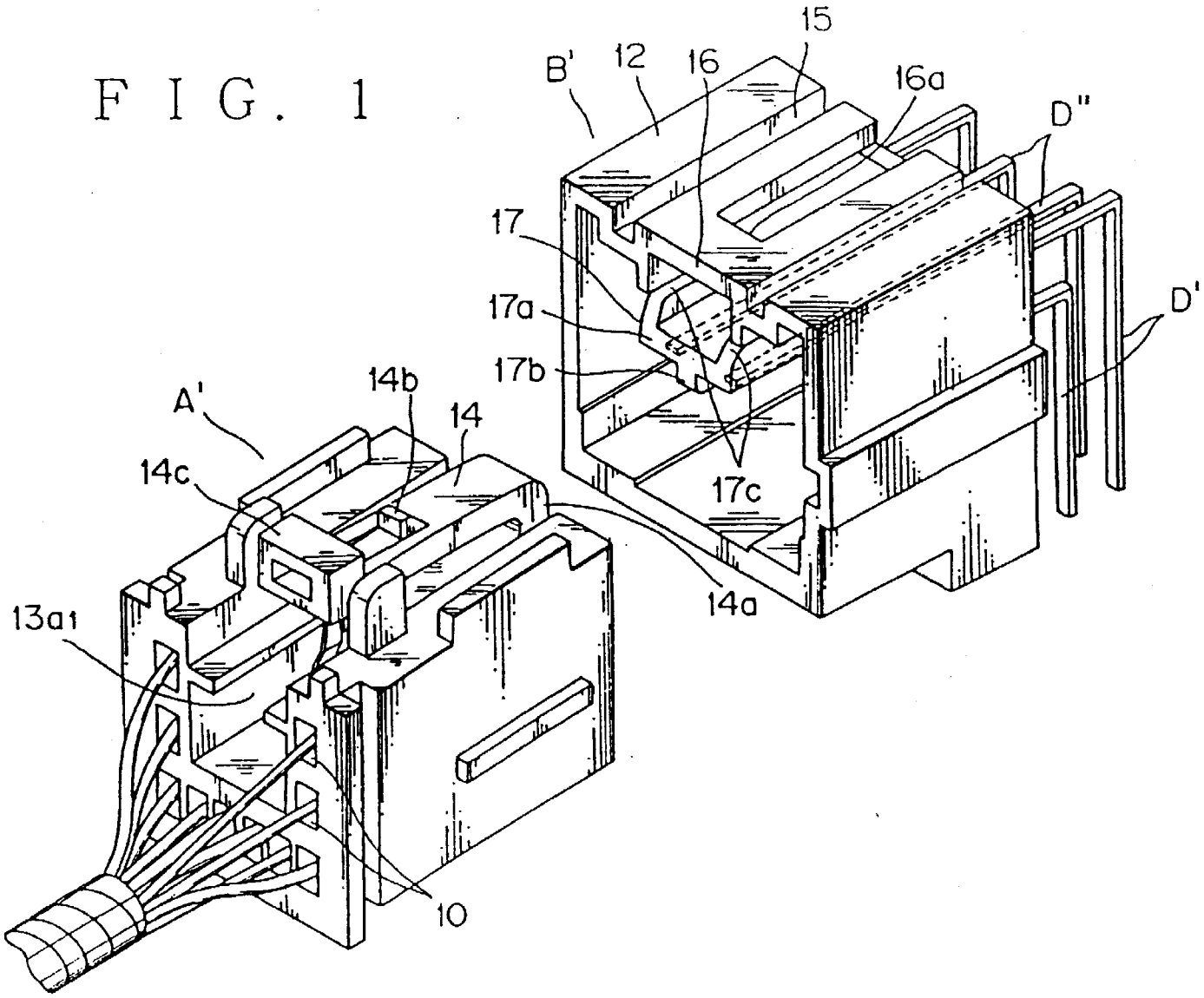
FIG. 1 is a perspective view of an embodiment of this invention, in which a male connector housing and a female connector housing are separated.
Figure 2:
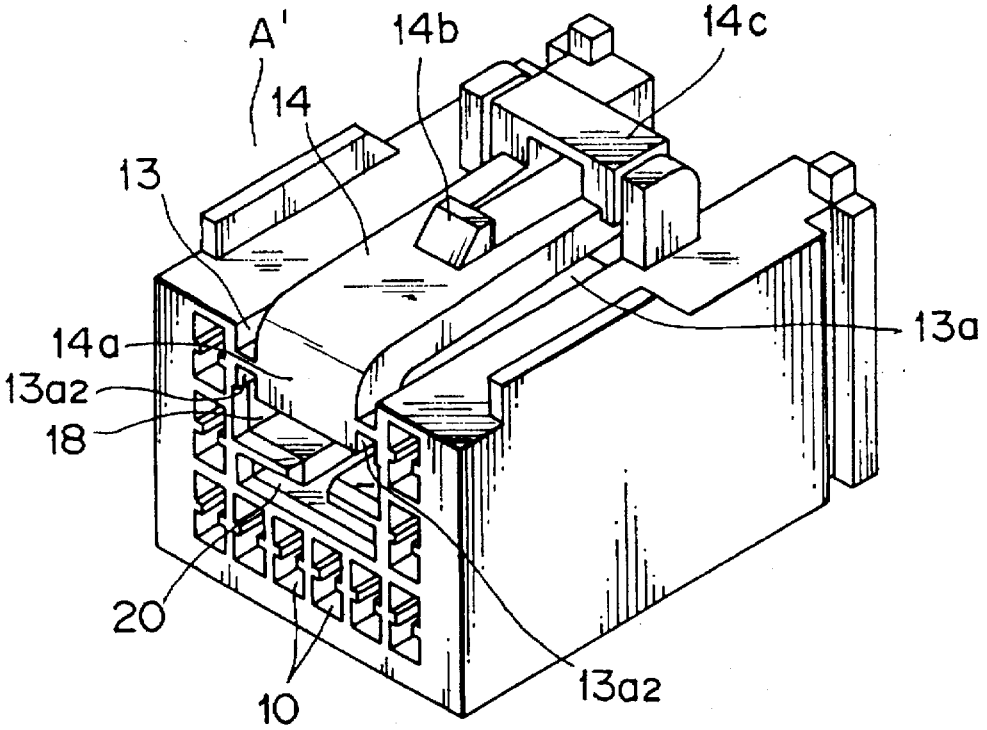
FIG. 2 is a perspective view of the male connector housing in regard to the embodiment.
Figure 3:
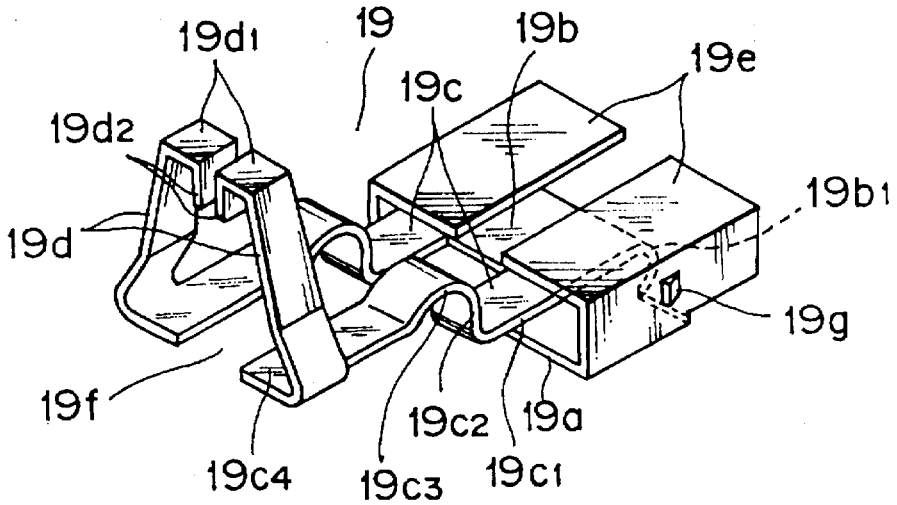
FIG. 3 is a perspective view of a short-circuit contact piece in regard to the embodiment.

Referring to FIG. 1, numeral A' denotes a male connector housing, numeral B' denotes a female connector housing for a printed circuit board, and both of the housings are formed of synthetic resin materials.

Figure 4:
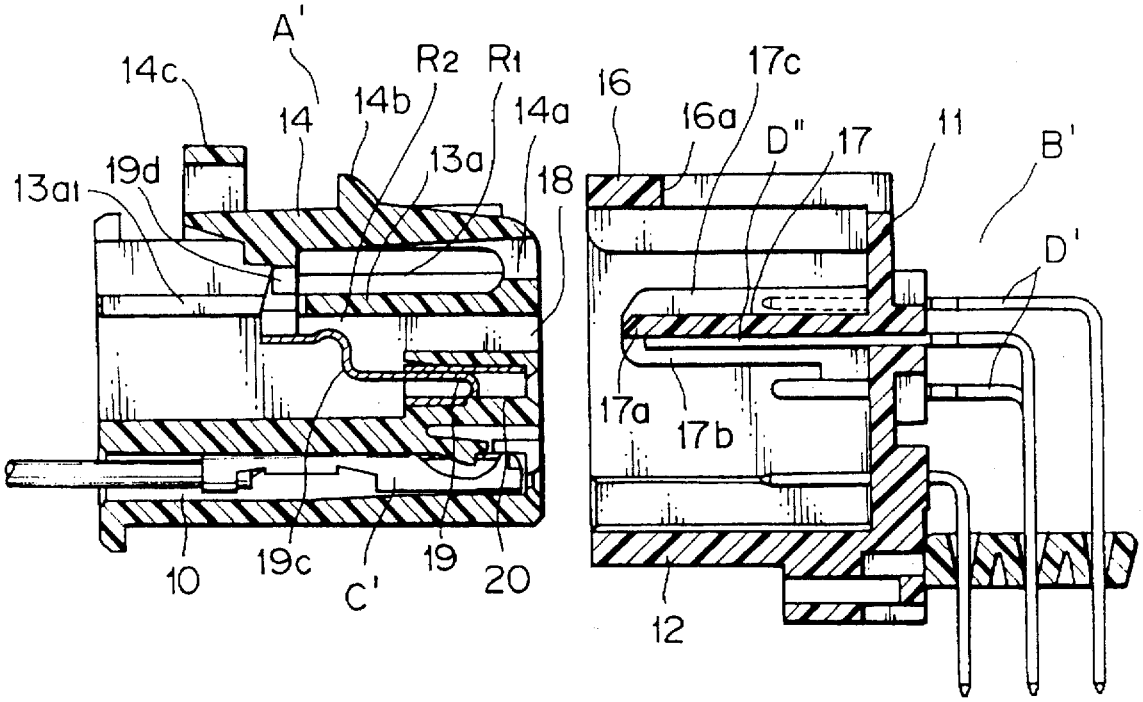
FIG. 4 are longitudinal sectional views of the male connector housing and the female connector housing, respectively, in regard to the embodiment.

In the male connector housing A', a plurality of terminal receiving cavities 10 are formed and female terminal pieces C' are inserted to be secured therein (as illustrated in FIG. 4). In regard to the female connector housing B', a plurality of terminal pins D', supported by a rear wall 11, are aligned in exterior walls 12.

In a recess or concave portion 13 defining a deflection space on an upper surface of the male connector housing A', a cantilever resilient lock arm 14 with a vertical base member 14*a* is provided as extending backwardly. On an upper surface of a middle part of the resilient lock arm 14, a lock projection 14*b* is formed, and on an upper surface of the free end portion of the resilient lock arm 14, an actuating portion 14*c* for unlocking is provided. At a center part of a forward end of a top wall 15 in regard to the female connector housing B', an engage frame 16 for cooperating with the resilient lock arm 14 is provided and a lock opening 16*a* corresponding to the lock projection 14*b* is also formed. When the male connector housing A' and the female connector housing B' engage with each other, the female terminal pieces C' and the male terminal pins D' make contact with each other. At that time, the lock projection 14*b* abuts on a fore end of the engage frame 16, whereby the resilient lock arm 14 deflects downwardly into a lower region, indicated as $R_1$, of the deflection space 13 (see FIG. 4) for allowing a deflection of the resilient lock arm 14 and then the lock projection 14*b* passes beneath the engage frame 16 until it reaches the lock opening 16*a*, and as the resilient lock arm 14 returns to the original position, the male connector housing A' and the female connector housing B' are completely engaged with each other and locked thereby.

In the exterior walls 12 defining the female connector housing B', a supporting frame 17 that cooperates with the engage frame 16 is provided so as to extend forward from the rear wall 11. The supporting frame 17 is formed in approximately T-shaped cross section by fitting a longitudinal partition plate 17*b* on the center line of the inside face of a horizontal plate 17*a* thereof. Further, compensating ribs 17*c* are provided so as to extend from the both sides of the horizontal plate 17*a*. A couple of terminal pins D" for detecting engagement ape provided at the both sides of the partition plate 17*b* so as to penetrate through the rear wall 11. The terminal pins D" are positioned so as to extend ahead of the male terminal pins D', and the supporting frame 17 is formed so as to extend ahead of the tip of the terminal pins D".

In the male connector housing A', a slot 18 in approximately T-shaped cross section for receiving the supporting frame 17 is formed so as to extend afterward and to be positioned coextensively with the resilient lock arm 14. Further, on a bottom wall 13*a* of the concave portion that forms the deflection space 13, grooves 13*a*2 are formed for inserting the compensating ribs 17*c*, and, under the slot 18, a slot 20 opened forward is formed for supporting a short-circuit contact piece 19.

The short-circuit contact piece 19 is formed of an elastic metal plate and has an base plate 19*a*, wherein an elastic plate portion 19*b* is formed adjacent to an arc-shaped folded portion 19*b*1 of the base plate so as to increase its elasticity. Further, a pair of cantilevered parallel elastic contact strips 19*c*/19*c* is formed with a slit 19*f* between them, like a fork, so as to extend from a fore end of the elastic plate portion 19*b*. Each of the elastic contact strips 19*c*/19*c* has a lower horizontal portion 19*c*1, a rising portion 19*c*2, an arc-shaped short-circuit contact portion 19*c*3, and an upper horizontal portion 19*c*4. An actuating portion of the short circuit contact piece 19 includes a pair of depressing portions 19*d*/19*d* formed so as to rise up from the free end of the elastic contact strips 19*c*. Turn out portions 19*e*/19*e* are provided above the elastic plate portion 19*b* by bending the base plate 19*a* at the both sides thereof. At the top of a pair of depressing portions 19*d*/19*d*, face plates 19*d*1/19*d*1 receiving a pushing force are formed so as to extend inward. On an inside end of the each face plate 19*d*1/19*d*1, each of abutting plates 19*d*2/19*d*2 is formed so as to extend downward and to oppose to each other, which prevents the depressing portions from falling down inward by supporting each other when a force is acted on them. The turn-out portions 19e/19e cover the elastic plate portion 19b and receive the force from the resilient lock arm 14. On a side plate adjacent to the turnout portions 19e/19e, a projection 19g is formed so that the contact piece 19 may be locked with the supporting slot 20.

The turn-out portions 19e/19e of the base plate 19a are inserted into and engaged with the supporting slot 20 so that the short-circuit contact piece 19 may be fixed thereby. The elastic contact strips 19c/19c extend afterward so that the contact portion 19c3 may be opposing, with a space R2, to the lower face of the bottom wall 13a of the concave portion 13. The depressing portions 19d/19d extend into the concave portion 13 through an opening 13a1 of the bottom wall 13a to abut on the lower surface of an unlocking actuating portion 14c of the resilient lock arm 14 (referring to FIG. 4). Each of the elastic contact strips 19c/19c can deflect independently to each other by having the slit 19f between them, which enables to short-circuit sufficiently a pair of the terminal pins D"/D" with the elastic contact pieces even if each of the terminal pins D" is deviated vertically from each other.

Figure 5:
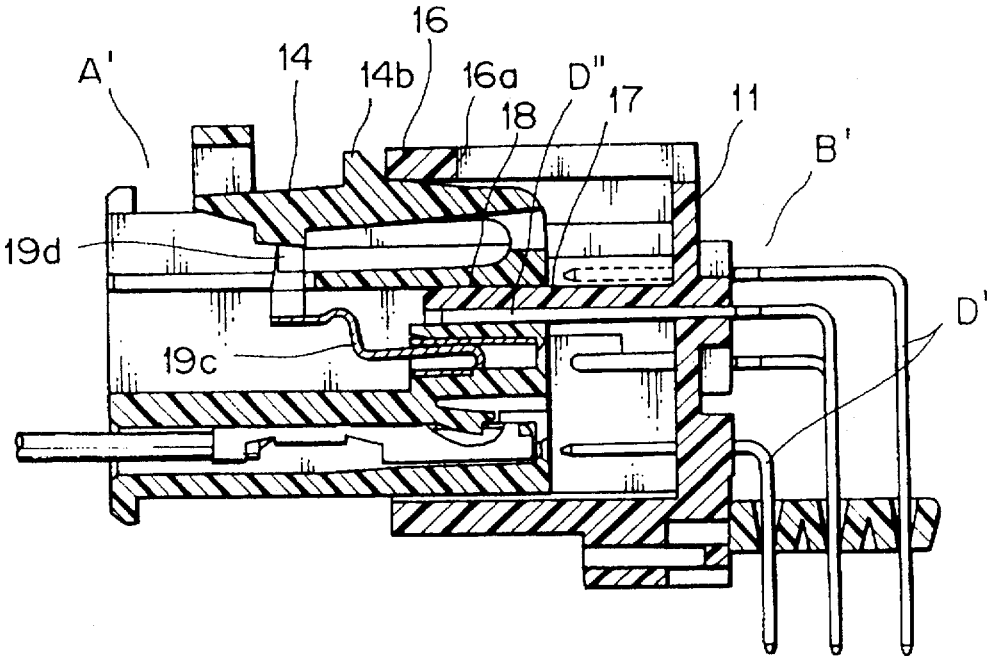
FIG. 5 is a longitudinal sectional view of an initially engaging state of the male connector housing and the female connector housing in regard to the embodiment.
Figure 6:
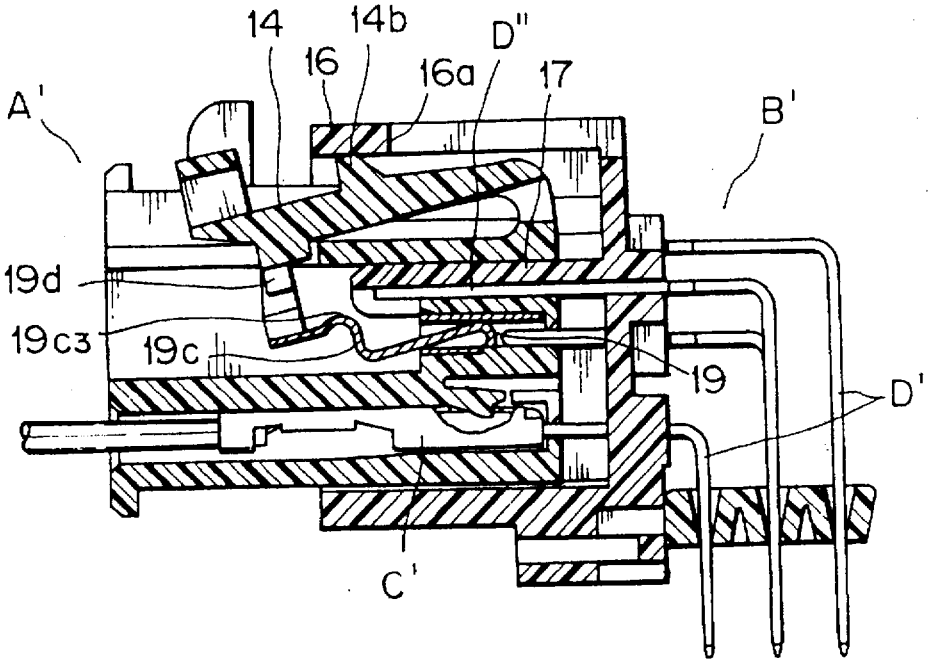
FIG. 6 is a longitudinal sectional view of an incomplete engaging state of the male connector housing and the female connector housing in regard to the embodiment.

In the above-mentioned structure, when the male connector housing A' and the female connector housing B' are initially engaging with each other, the supporting frame 17 and the terminal pins D" for detecting engagement advance into the slot 18 (referring to FIG. 5). In a further engagement step, the advancing ends of the supporting frame 17 and the terminal pins D" come into the space R2. Then, the lock projection 14b abuts on the upper inside surface of the engage frame 16, whereby the resilient lock arm 14 deflects downwardly into the deflection space R1 and, accordance with the deflection of the resilient lock arm 14, the elastic contact strips 19c/19c of the short-circuit contact piece 19 deform to make the space R2 larger. Thus, the terminal pins D" are prevented from making contact with the short-circuit contact piece 19 (referring to FIG. 6).

Figure 7:
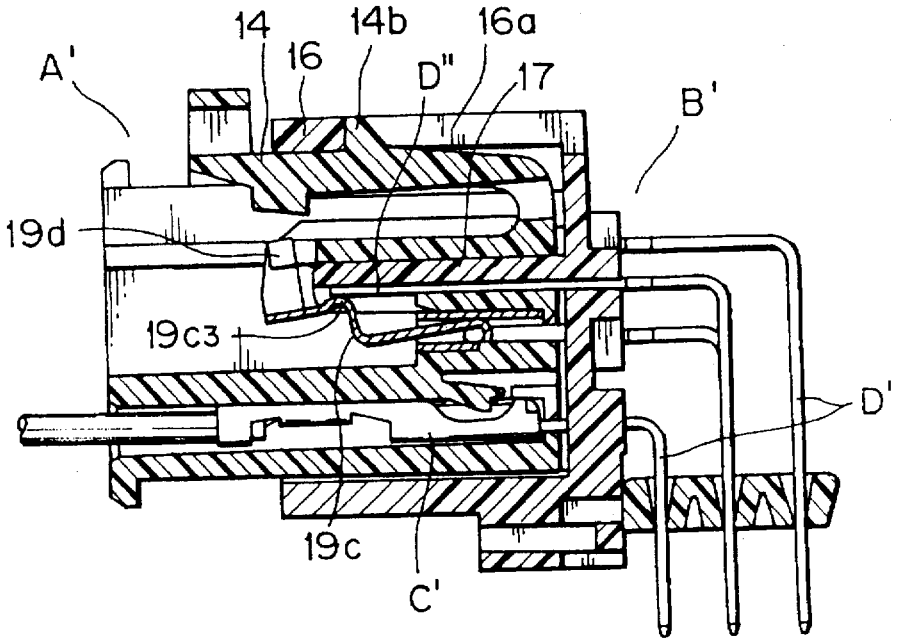
FIG. 7 is a longitudinal sectional view of a complete engaging state of the male connector housing and the female connector housing in regard to the embodiment.
Figure 8:
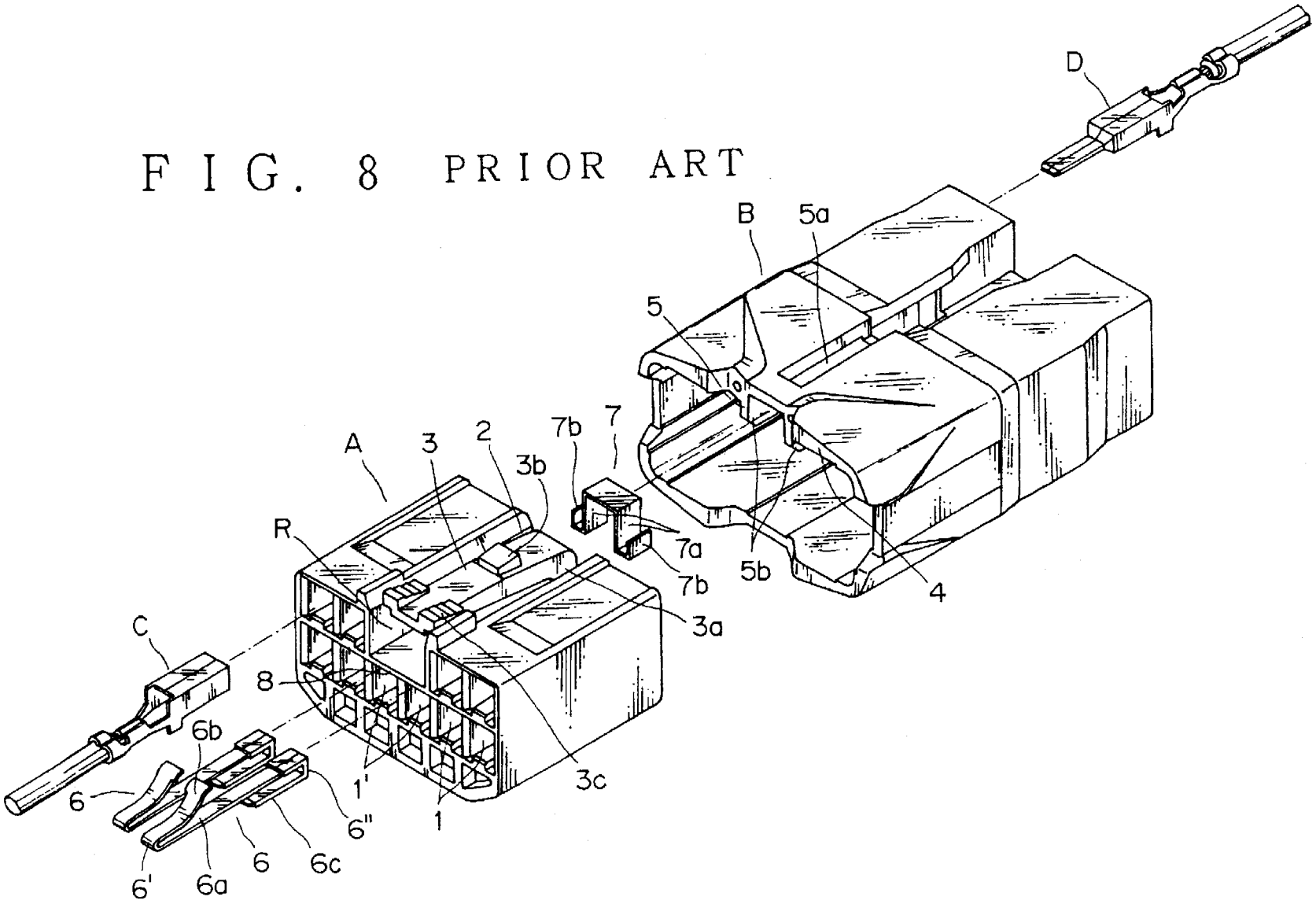
FIG. 8 PRIOR ART
FIG. 8 is a perspective view of a prior art device, in which a male connector housing and a female connector housing are separated.
Figure 9A:
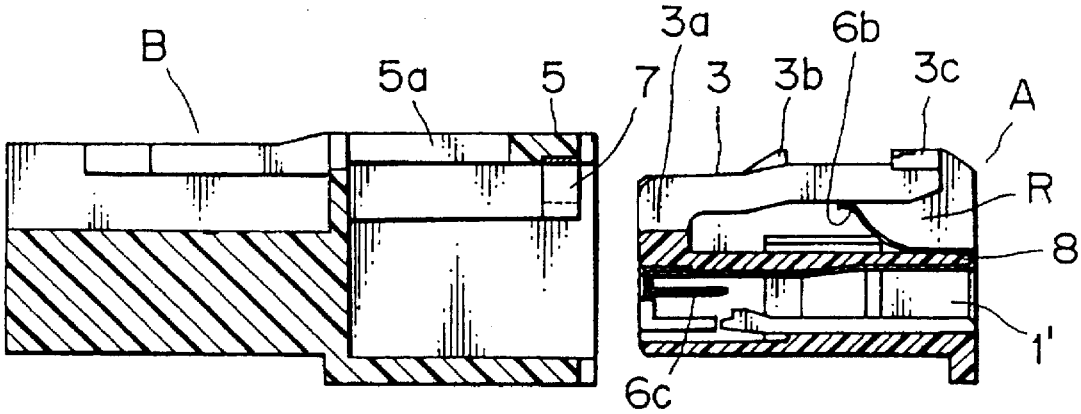
FIG. 9A PRIOR ART
FIG. 9A shows the male connector housing and the female connector housing separated.
Figure 9B:
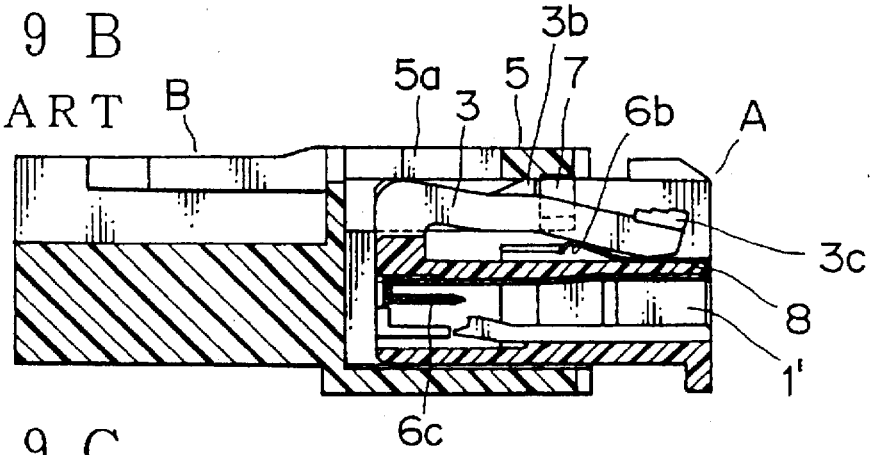
FIG. 9B PRIOR ART
FIG. 9B shows an incomplete engaging state of the connectors.
Figure 9C:
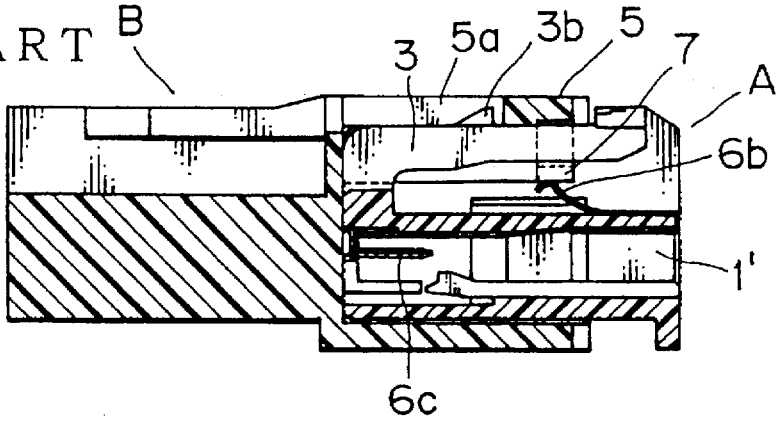
FIG. 9C PRIOR ART
FIG. 9C shows the complete engaging state of the connectors.

On the other hand, when the male connector housing A' and the female connector housing B' are completely engaged with each other, the resilient lock arm 14 returns to the original position so that the elastic contact strips 19c/19c return to their initial positions, and the contact portions 19c3/19c3 make contact with a pair of the terminal pins D"/D" for detecting engagement. Consequently, a detecting electric circuit is actuated (referring to FIG. 7).

In the first aspect of this invention, there is provided a more compact connector engagement detecting apparatus by leaving out the conventional contact pieces to detect the complete engagement. Further, the contact portion of the short-circuit contact piece is protected appropriately by the connector housing walls to achieve a stable engagement detection.

In the second aspect of this invention, the compensating ribs prevent the supporting frame from deforming so that the terminal pins for detecting engagement may not be distorted as they are held by the supporting frame, whereby a stable electric connection is enabled.

In the third aspect of this invention, when a pair of the connectors engage with each other, only the fore end of the supporting frame works as a guide during the engagement, which prevents the tip of the terminal pin for detecting engagement from abutting the corresponding terminal and from being distorted thereby.

What is claimed is:

1. A connector engagement detecting apparatus comprising:

a first connector housing having a recess provided on an upper surface thereof to form a deflection space containing a bottom wall, a resilient lock arm disposed in said deflection space above said bottom wall, and a second connector housing having an engaging portion for receiving the resilient lock arm;

a short-circuit contact piece having a resilient body carried by the first connector housing, said short circuit contact piece containing at least one cantilevered elastic contact strip having an elastic short circuit contact portion positioned in the first connector housing, said short-circuit contact portion of the elastic contact strip being spaced beneath the bottom wall of the deflection space, a depressing portion of the short-circuit contact piece extending above the deflection space bottom wall in opposition to the resilient lock arm whereby the short circuit contact piece is engageable with said resilient lock arm and deflected in response to the deflection of the resilient lock arm, a couple of terminal pins for detecting engagements provided on a supporting frame in the second connector housing and being disposed in opposition to the short-circuit contact piece, whereby, when the first and the second connector housings are completely engaged with each other, the short-circuit contact portion of said short-circuit contact piece makes contact with the couple of terminal pins for detecting engagement, and, when the first and the second connector housings are incompletely engaged with each other, the resilient lock arm is deflected to displace the short-circuit contact piece to prevent said contact portion of said contact piece from making contact with the couple of terminal pins for detecting engagement.

2. A connector engagement detecting apparatus as claimed in claim 1, wherein a lock projection formed on the resilient lock arm is abutted on an upper inside surface of an engage frame of the engaging portion, whereby the resilient lock arm deflects into the deflection space when the first and the second connector housings are incompletely engaged with each other.

3. A connector engagement detecting apparatus as claimed in claim 1, wherein the supporting frame is formed so as to extend forward from a rear wall of the second connector housing and compensating ribs are provided on the supporting frame.

4. A connector engagement detecting apparatus as claimed in claim 3, wherein the supporting frame is formed in an approximately T-shaped cross section in which a longitudinal partition plate is provided on a center line of an inside face thereof and each of the couple of the terminal pins for detecting engagement is provided at each side of the partition plate.

5. A connector engagement detecting apparatus as claimed in claim 1, wherein the supporting frame is extending ahead of tips of the terminal pins for detecting engagement.

6. A connector engagement detecting apparatus as claimed in claim 1, wherein the body of the short-circuit contact piece is formed of an elastic metal plate and has a base plate; an elastic plate portion is formed adjacent to an arc-shaped folded portion of the base plate so as to increase its elasticity; a pair of cantilevered parallel elastic contact strips are formed with a slit between them so as to extend from a forward end of the elastic plate portion; and each of the elastic contact strips has a lower horizontal portion, a rising portion, an arc-shaped contact portion, and an upper horizontal portion.

7. A connector engagement detecting apparatus as claimed in claim 6, wherein said elastic contact strips are bent at the both sides of said slit to form a pair of depressing portions which rise up from the free ends of the elastic contact pieces.

8. A connector engagement detecting apparatus as claimed in claim 7, wherein, at the top of the pair of the depressing portions, face plates for receiving a pushing force from said resilient lock arm are formed so as to extend inwardly, and, on an inside end of each face plate, each of a pair of abutting plates is formed so as to extend downwardly and to oppose to each other.

9. A connector engagement detecting apparatus as claimed in claim 6, wherein the short-circuit contact piece has a pair of turn-out portions adjacent to side plates connecting with the base plate so as to cover the elastic plate portion and to receive a force from the resilient lock arm.

10. A connector engagement detecting apparatus as claimed in claim 9, wherein, on the side plate adjacent to the turn-out portion, a projection is formed so that the contact piece may be locked with a corresponding supporting slot.

* * * * *